United States Patent [19]

De Martino

[11] 4,371,916

[45] Feb. 1, 1983

[54] MOTOR-VEHICLE LAMP WITH BASE AREA ILLUMINATION

[75] Inventor: Ennio De Martino, Turin, Italy

[73] Assignee: IAO Industrie Riunite S.p.A., Turin, Italy

[21] Appl. No.: 86,407

[22] Filed: Oct. 19, 1979

[30] Foreign Application Priority Data

Oct. 30, 1978 [IT] Italy ..... 69490 A/78

[51] Int. Cl.[3] ..... F21V 7/04

[52] U.S. Cl. ..... 362/31; 362/309; 362/331; 362/332; 362/337; 362/340

[58] Field of Search ..... 362/309, 330, 332, 337, 362/339, 333, 340, 31, 331

[56] References Cited

U.S. PATENT DOCUMENTS

| | | | |
|---|---|---|---|
| 1,252,505 | 1/1918 | Steinman | 362/339 |
| 1,626,615 | 3/1927 | Kirby | 362/339 |
| 2,246,320 | 6/1941 | Rolph | 362/309 |
| 2,454,332 | 11/1948 | Mitchell | 362/337 |
| 2,566,126 | 8/1951 | Franck | 362/309 |
| 3,020,395 | 2/1962 | Peltz | 362/330 |
| 3,413,508 | 11/1968 | Pitkjaan | 362/309 |
| 3,679,889 | 7/1972 | Franck | 362/340 |

FOREIGN PATENT DOCUMENTS

| | | | |
|---|---|---|---|
| 1430576 | 1/1969 | Fed. Rep. of Germany | 362/309 |
| 650352 | 2/1951 | United Kingdom | 362/309 |

*Primary Examiner*—Peter A. Nelson

*Attorney, Agent, or Firm*—James B. Raden; William J. Michals

[57] ABSTRACT

A lamp for motor-vehicles wherein the base area of the prismatic cap is encompassed by a transparent plate in direct optical contact with the base area and adapted to direct into its interior the light emerging from the base area in a substantially radial direction and to direct it forwardly thereby forming a luminous halo surrounding the cap.

1 Claim, 2 Drawing Figures

MOTOR-VEHICLE LAMP WITH BASE AREA ILLUMINATION

BACKGROUND OF THE INVENTION

In my main patent—Italian patent application No. 67392-A/78 entitled Lamp for Motor-Vehicles and filed Feb. 27, 1978—there is described and claimed a lamp for motor vehicles, comprising a base which may be fixed to the body of the motor vehicle, a lamp bulb supported by the base, and a transparent cover fixed to the base to enclose the bulb, the said lamp being characterized by the fact that for the collection of the beam of light emitted by the lamp bulb into a beam having desired photometric characteristics there is provided a transparent prismatic cap interposed between the cover and the bulb.

The advantages deriving from the invention of the main patent are particularly noticeable in those cases, provided for in the patent, in which a cluster of lights (comprising, for example, parking light, stop light, reversing light etc.) constitute an integral part of the profile of the body, rather than a unit in itself, affixed to the body.

The present invention follows from the observation that often, for reasons of design, it is desirable that one or more lights should cover on the outside a relatively extensive area, much greater than that suitable for the said cap. At the same time, it has become desirable that, particularly for a parking light or stop light the said cap should not create (when the light is lit) a spot of extreme luminosity in the middle of the said relatively extensive area. In principle, it should be possible to overcome this difficulty by means of an appropriate "prismatic" configuration of the transparent cap of the lamp; this would, however, mean a return to precisely those problems which the main patent was intended to avoid.

SUMMARY OF THE INVENTION

According to the present invention, a lamp made according to the main patent is further characterized by the fact that the base area of the prismatic cap is surrounded by a transparent plate, in direct optical contact with the said area, adapted to direct into its interior the light of substantially radial direction coming from the said area and to redirect it forwards to form a luminous halo encompassing the cap. In this way, the luminous contrast between the area occupied by the cap and the surrounding area is appreciably reduced, and use is made of the ring of radial (or substantially radial) rays which, without the said plate, would be virtually lost, since it would be so difficult for them to be collected by the cap.

For the plate, the same transparent materials may be used as have already been envisaged for the cap, such as polymethylmethacrylate ("plexiglas"), polycarbonate or transparent acrylonitrite-styrene copolymers. The plate may be molded in one single piece with the cap. It is preferable, however, to mold it separately, conforming to the shape and dimensions of the area which the lamp is to occupy on the body, and then to insert it subsequently on the base of the cap through a central hole and to secure it firmly to the said base. The mating surfaces should preferably be completely smooth, which is easy to obtain directly in the molding, such that there is no obstruction to the direct transmission of light from the cap in the plate. If necessary, it is possible to ensure or improve the continuity of distance covered by the rays by making use for the fixing of a transparent synthetic adhesive (for example, a cyanacrylic adhesive) adapted to constitute an "optical bridge" between the surfaces of contact.

The plate is preferably flat. However, it could also be slightly concave or convex towards the front if this is necessary or expedient. The front or the rear surface of the plate is preferably prismatic, in accordance with the principles already known in optics, that is, with frontal prisms functioning by refraction or with rear prisms functioning by total reflection, such that in each case the path of light directed into the interior of the plate can emerge from the front surface of the latter thus giving the plate the appearance of a luminous screen. Preferably, the prisms are formed by grooves concentric with the axis of the cap.

BRIEF DESCRIPTION OF THE DRAWING

FIG. 1 is an axial section of a lamp according to the invention while

DETAILED DESCRIPTION

Line A—A indicates an axial plane containing the axis X of a lamp bulb 10. A prismatic cap 12, is constructed and cooperates with lamp bulb 10 in the manner described in the above-identified patent. The base 12A of the cap 12 is substantially coplanar with the focus F of the lamp bulb and is therefore invested from the interior with a ring of rays R directed radially with respect to the axis X. It may be noted that in the conditions described in the principal patent this ring of rays would be scarcely (if at all) exploited by the cap 12.

Figure 1:
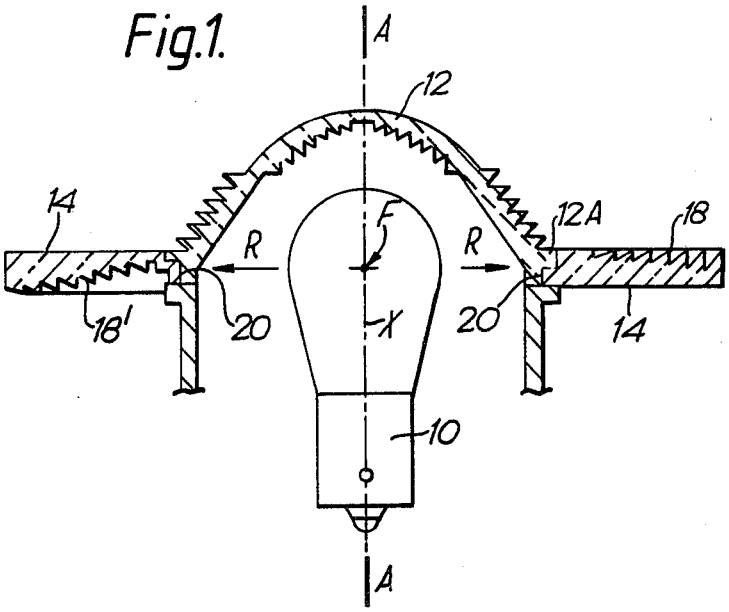
Figure 2:
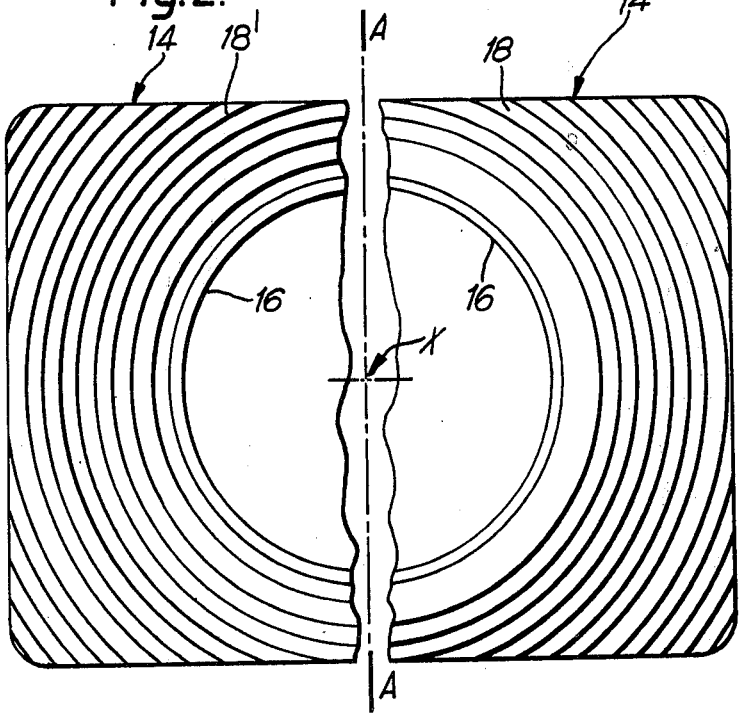
FIG. 2 is a front end view of the relevant plate.

A transparent plate 14, of rectangular flat shape, having a circular central aperture 16 is mechanically and optically coupled to the base 12A (assumed likewise to be circular) of the cap 12, as explained above. In the two figures of the drawing, there are shown two embodiments of the plate, illustrated respectively to the right and to the left of the plane A—A. In the embodiment illustrated to the right, the plate 14 has prismatic elements 18 formed in its front surface, while in the embodiment illustrated on the left the prismatic elements 18' are formed in the rear surface of the plate. In both cases the prismatic elements are made up of circular grooves concentric with the axis X (FIG. 2). When the lamp 10 is lit, the rays R are collected and directed from the plate 14 to its interior, and then directed forwardly from the respective prism elements 18, 18', as a result of which the cap 12 is encompassed by a luminuous screen having the shape of the plate, that is, in this case, rectangular.

It will be evident from the drawing that by selecting an appropriate thickness for the plate, or the axial extension of the interface of contact 20 between the plate and the cap, it is possible to direct towards the plate and in the plate a convenient proportion of total luminous flux of the lamp 10, in particular that which in each case would be scarcely exploited by the cover cap 12. In the majority of cases it has been found that a thickness on the order of 5–6 mm is sufficient to obtain the desired effects.

I claim

1. In a lamp for a motor vehicle of the type having a lamp bulb having a central axis concentrically surrounded by a convex prismatic cap and wherein the base portion of said cap is substantially coplanar with the central point of the light source within said lamp bulb, the improvement therewith comprising:

a transparent plate having a central circular aperture surrounding and being mechanically and optically coupled to said coplanar base portion of said cap, said plate including a plurality of prismatic elements comprising circular grooves concentrically surrounding said central axis of said lamp bulb wherein the radially directed luminous light flux emanating from said central point of said light source within said lamp bulb is collected and directed toward said prismatic elements in said plate and then directed forwardly away from the surface of said plate in directions which are parallel to the central axis of said lamp bulb, whereby said plate becomes luminous.

* * * * *